US005547177A

United States Patent [19]

Merkli et al.

[11] Patent Number: 5,547,177

[45] Date of Patent: Aug. 20, 1996

[54] METHOD AND APPARATUS FOR REPLACING INCOMPLETE PRINTED PRODUCTS IN THE PRODUCTION OF NEWSPAPERS, MAGAZINES AND SIMILAR PRODUCTS

[75] Inventors: Peter Merkli, Oftringen; Heinz Linder, Zofingen, both of Switzerland

[73] Assignee: Grapha-Holding AG, Hergiswil, Switzerland

[21] Appl. No.: 266,500

[22] Filed: Jun. 27, 1994

[30] Foreign Application Priority Data

Jun. 29, 1993 [CH] Switzerland ..... 01946/93

[51] Int. Cl.[6] ..... B65H 7/20; B65H 39/02

[52] U.S. Cl. ..... 270/52.05; 270/58.22; 270/52.14

[58] Field of Search ..... 270/54, 55, 57, 270/58

[56] References Cited

U.S. PATENT DOCUMENTS

| | | | |
|---|---|---|---|
| 3,899,165 | 8/1975 | Abram et al. | 270/54 |
| 3,953,017 | 4/1976 | Wise | 270/58 X |
| 4,121,818 | 10/1978 | Riley et al. | 270/54 |
| 5,011,123 | 4/1991 | Vigano | 270/54 |
| 5,098,076 | 3/1992 | Kelsey | 270/54 |
| 5,171,005 | 12/1992 | Manley et al. | 270/55 X |
| 5,267,821 | 12/1993 | Bodart et al. | 270/54 X |
| 5,326,209 | 7/1994 | Duke | 270/54 X |

FOREIGN PATENT DOCUMENTS 1333357 10/1973 United Kingdom .

*Primary Examiner*—John E. Ryznic
*Attorney, Agent, or Firm*—Spencer & Frank

[57] ABSTRACT

A method and apparatus for assembling printed products. The method and apparatus involve the selective delivery of the printed products to receiving devices situated in succession along a production line formed by a plurality of controlled sheet feeder stations. Printed products are selectively supplied to a receiving device at a discharge end of the production line, and transferred to a helical circulation track guiding a plurality of further receiving devices driven in synchronism with the production line through a feed path disposed between the discharge end of the production line and the circulation track. Any incomplete printed products are removed from the printed products, and replaced with replacement complete printed products by delivery of the replacement complete printed products to respective receiving devices of the circulation track corresponding to removed incomplete printed products at a feed point in the circulation track through the feed path. The feed path is thus adapted to transfer both originally complete printed products and replacement complete printed products to the circulation track.

12 Claims, 2 Drawing Sheets

METHOD AND APPARATUS FOR REPLACING INCOMPLETE PRINTED PRODUCTS IN THE PRODUCTION OF NEWSPAPERS, MAGAZINES AND SIMILAR PRODUCTS

BACKGROUND OF THE INVENTION

The invention relates to a method for producing newspapers, magazines and similar products by feeding printed products from receiving devices that follow along a production line formed of a plurality of open-loop or closed-loop controlled sheet feeder stations.

Production processes of this kind are known in the field of further processing of printed matter. For example, with the use of insetting machines, newspapers are produced by inserting enclosures or preprinted products into a main product serving as an envelope, or by assembling enclosures within an open main product.

Gather-stitching can be carried out in the same way, in which the printed sheet fed to a production line is gathered and spread over saddle-like supports in preparation for the stitching process.

Conditions involved in this process include high production safety and quality, and reliable execution of the programmed processing process. In particular, this includes the manufacturing of complete products.

Another need is for the capability to do customized production, completely independent of the process of assembling the products. In particular, with customized products that have an individualized composition and are associated with an addressed destination, a definite order must be absolutely adhered to. Until now, this requirement could not be met without additional effort and expense.

Moreover, a restriction in the selection of products must be precluded.

SUMMARY OF THE INVENTION

It is an object of the invention to create a method of the type referred to at the outset, with which at the end of the production process, despite any errors in the products produced that may have occurred, the programmed order is not impaired, and the required final product can be produced in a simple way and without interrupting the processing process.

According to the invention, this object is attained in that the printed products selectively delivered to a receiving apparatus or receiving devices of a production line are transferred from a receiving device at an end of the production line to a circulation track guiding a further plurality of receiving devices driven in synchronism with the production line, and incomplete products are replaced, before leaving the circulation track with like products that are complete.

This kind of procedure makes it possible for defective products produced along the production line to be replaced at the correct point in the selected order by complete products.

Suitably, the complete products that replace the incomplete products are remanufactured during production on the production line, and can be fed to the receiving devices in the circulation track from which the incomplete or defective products have been removed, at a feed point communicating with a feed path between the production line and the circulation track, and the distance between the end of the production line and the circulation track varies depending on the cooperation between the production line and the circulation track and/or on the kind of disposition and embodiment of the circulation track.

The circulation track may either be embodied as endless, or may have one end at the front, in terms of the conveying direction, that communicates with the production line and one rear end, communicating with one or more destination points; however, the incomplete or defective products are rejected from the circulation track upstream of the feed point.

If the products are uniform, a defective product can be replaced with a complete product supplied from a storage device along the course of the circulation track.

When nonuniform products are manufactured, this capability is not suitable, because a larger number of storage devices or sheet feeders along the circulation track reduce the utility of the invention.

The embodiment according to the invention offers several possibilities in the design and mode of disposition of the circulation track in connection with the production line.

Among others, for instance, on the downstream end of the production line formed by the sheet feeder stations, the receiving devices are operatively coupled with a circulation track guiding the receiving devices. The circulation track operates in an intermittent or incremental manner and thereby makes it possible to replace products without causing a delay or interruption in the processing process.

With the circulation track downstream of the end of the production line, a transfer path for all the products including a feed path for the replacement products from the production line to the circulation track can be implemented with intermediate conveyors or transfer mechanisms.

Advantageously, the transfer point for all products on the circulation track precedes the feed point for replacement products on the circulation track, in terms of the direction in which the products are conveyed on the circulation track.

The removal of the finished products from the apparatus according to the invention is done at a discharge location, which is disposed downstream of the transfer point and the feed point, in terms of the conveying direction, along the circulation track.

In the event that transfer means between the production line end and the circulation track are used, it is possible to embody the circulation track as an endless line and dispose it adjacent to the production line end, so that the transfer means connect the production line and the circulation track.

In another embodiment of the apparatus according to the invention, the production line, with its downstream end or indirectly by means of an extension at the transfer point, discharges into the circulation track, and as a result additional transfer means are no longer necessary.

In terms of a further feature, it is especially favorable if the circulation track downstream of the transfer point is embodied helically, so that it extends below the level of the production line or runs under it at the end located downstream; in other words, the production line discharges at least indirectly into the upstream end of the helical circulation track.

Because the ends of the helical circulation track advantageously form a feed point, the complete product replacing the incomplete product can in a simple way be transferred from a receiving device carried on the top of the circulation track to a receiving device extending on the circulation track immediately therebelow.

To that end, the receiving devices may be embodied in pocket-like fashion and may be embodied with a bottom driven so as to open.

With either an endless or a helical circulation track, a removal point for removal of the incomplete products is provided upstream of the feed point, in terms of the conveying direction. This removal point may be embodied as controllable so that one kind of incomplete product is separated from the others.

Advantageously, the circulation track is at least as long as the production line, so that at least all the enclosures that form the complete products can be detected by the procedure according to the invention.

The method of the invention and the apparatus associated with it may be used both as an insetting machine and as a gather-stitcher; in the case of the insetting machine, the receiving devices are equipped in the form of pockets that can be supplied from above, with an opening mechanism on the bottom, and in the corresponding gather-stitcher, the receiving devices are embodied as saddle-like supports with associated transfer means.

A modified helical circulation path has two turns extending one above the other, with the production line discharging into the upper turn.

This arrangement makes it possible for the receiving devices traveling along the upper circulation track and the receiving devices traveling along the lower circulation track to form a feed point, downstream of the removal point, of two pocket-like receiving devices that communicate approximately vertically.

The discharge location of the finished products is located at the end of the lower winding of the double circulation track.

BRIEF DESCRIPTION OF THE DRAWINGS

The method of the invention and the apparatus will be described in further detail below, in terms of an exemplary embodiments shown in the drawing, wherein.

DETAILED DESCRIPTION OF THE PREFERRED EMBODIMENTS

Figure 1:
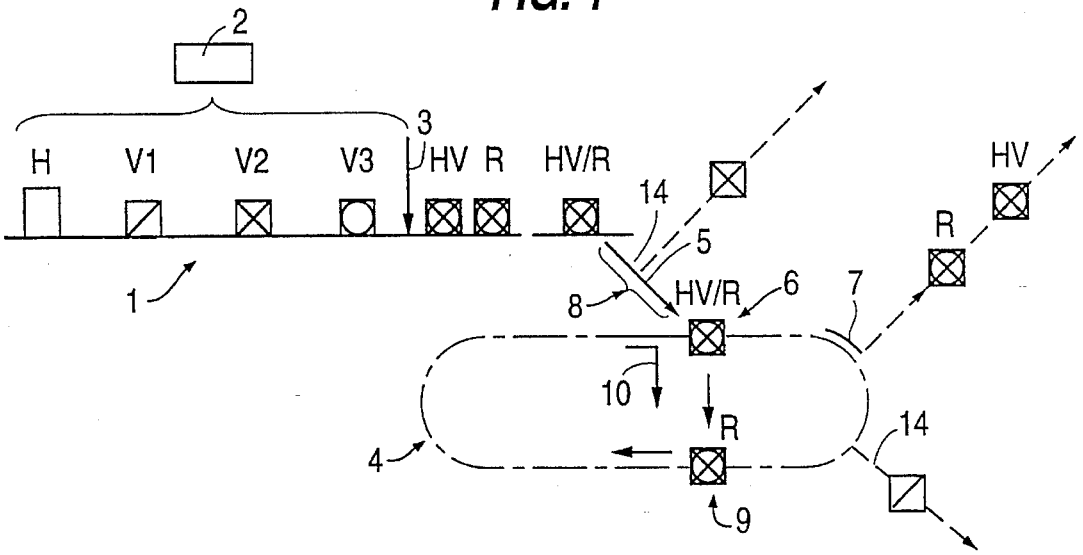
FIG. 1 is a schematic illustration of an embodiment of the apparatus according to the invention.

FIG. 1 schematically shows one embodiment of the apparatus of the invention. In the case of an insetting means, four supply stations are located along the production line 1; of these supply statons, H indicates the sheet feeder for the main sheet, while the sheet feeders $V_1$–$V_3$ are intended for enclosures or preprinted products. The production line 1 is connected to an open-loop control apparatus 2, which controls the insetting machine and monitors and checks the processing process; that is, apparatus 2 ascertains the presence of any defective or incomplete products and sends signals accordingly for further handling.

Arrow 3 indicates the end of the production line 1, from which the products are transferred to a circulation track 4. Defective products can be rejected from the processing process as they leave the production line 1, or may be rejected after they arrive at the circulation track 4.

HV indicates a properly manufactured, complete product, which can be moved to the circulation track 4 or the receiving devices of circulation track 4 from the production line 1 by means of transfer means 5, such as a transporter with grippers, along a feed path 8 at a transfer point 6. Once complete product HV has traveled through the circulation path 4, it is discharged from the circulation path, for instance at a delivery place 7, or at discharge location place 10.

An incomplete product rejected from the processing process at either of points 14 is remanufactured (R) along the production line 1 and then transferred by transfer means 5 along feed path 8 to transfer point 6 and then to a feed point 9 of the circulation track 4, where the receiving device for the previously removed incomplete product is located.

This remanufactured product R fills the gap in the product previously rejected because of incompleteness.

Provision is made for removing the complete products HV or the remanufactured products R downstream of the feed point 9 of the circulation path 4, at a discharge location 10.

Figure 2:
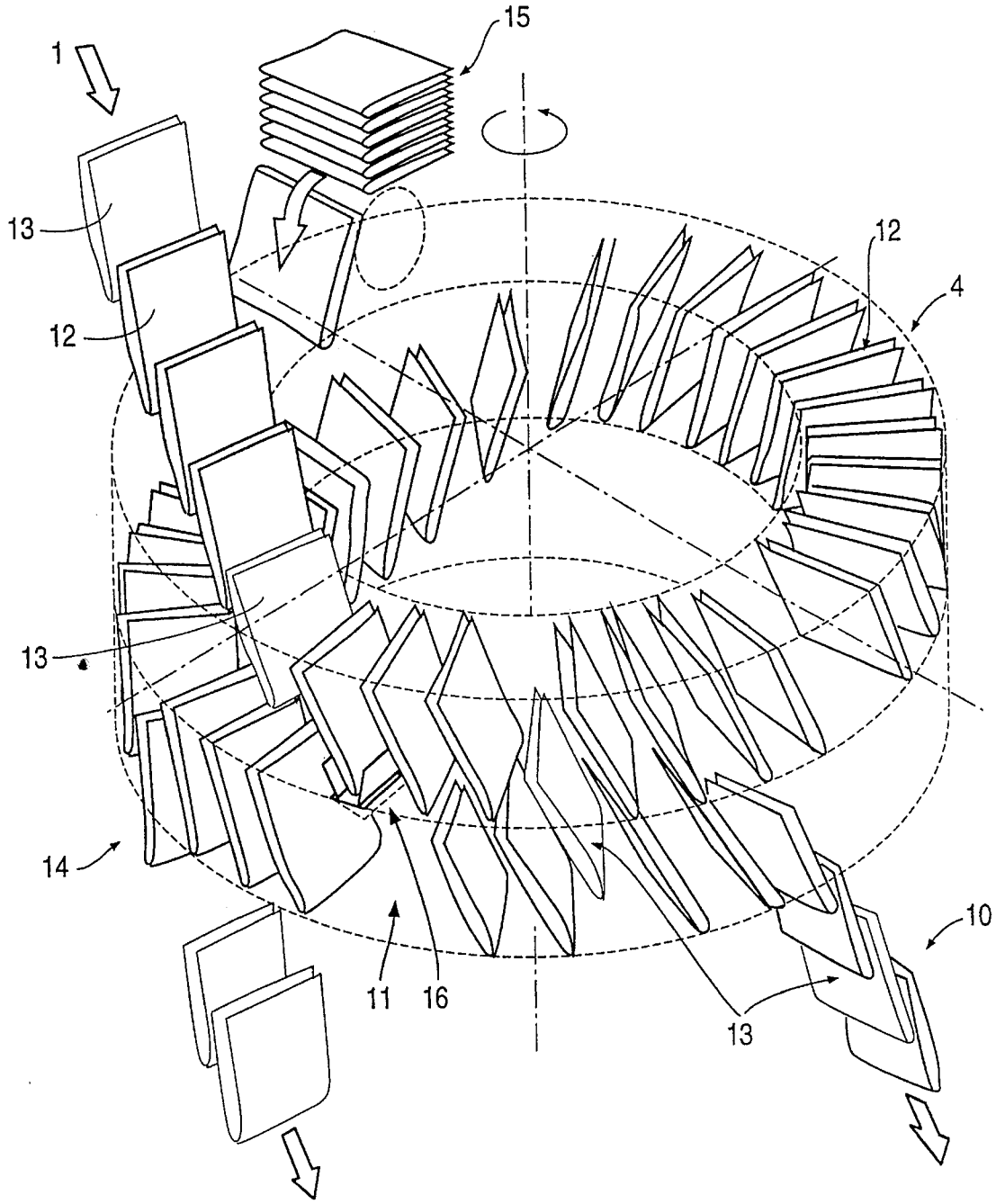
FIG. 2 is an illustration of the replacement process with a helical circulation path.

FIG. 2 shows an embodiment of the apparatus according to the invention in which the production line 1 discharges into or merges with a helical circulation track 4; the receiving devices 11 have previously been carried past a production line formed of a plurality of sheet feeder stations, and have been supplied. Reference numeral 12 indicates the complete products arriving from the production line, while reference numeral 13 indicates the remanufactured products. All the products travel through the helical circulation track 4. In the case of defective products or incomplete products, they are rejected from the process at a removal point 14.

The empty receiving devices 11, represented by voids, remaining on the circulation track 4 and corresponding to removed incomplete products are now supplied with a remanufactured complete product fed from above, and among other results, the gap that had been created is filled.

No change in the order of the products ensues, because the remanufactured product is an additional product. The empty space it leaves behind is compensated for by open-loop control, so that there is no change in the program for delivery of the complete products. Remanufactured complete products 13 are dropped from the pocket-like receiving devices 11 through openable bottoms 16 of the receiving devices.

On an exceptional basis, voids in accordance with the program, or receiving devices 11 from which products have been removed, can also be supplied from a storage device 15; such an expedient can be preferably used with uniform products.

It is not suitable, however, if continuous production of different products takes place along the production line 1.

Figure 3:
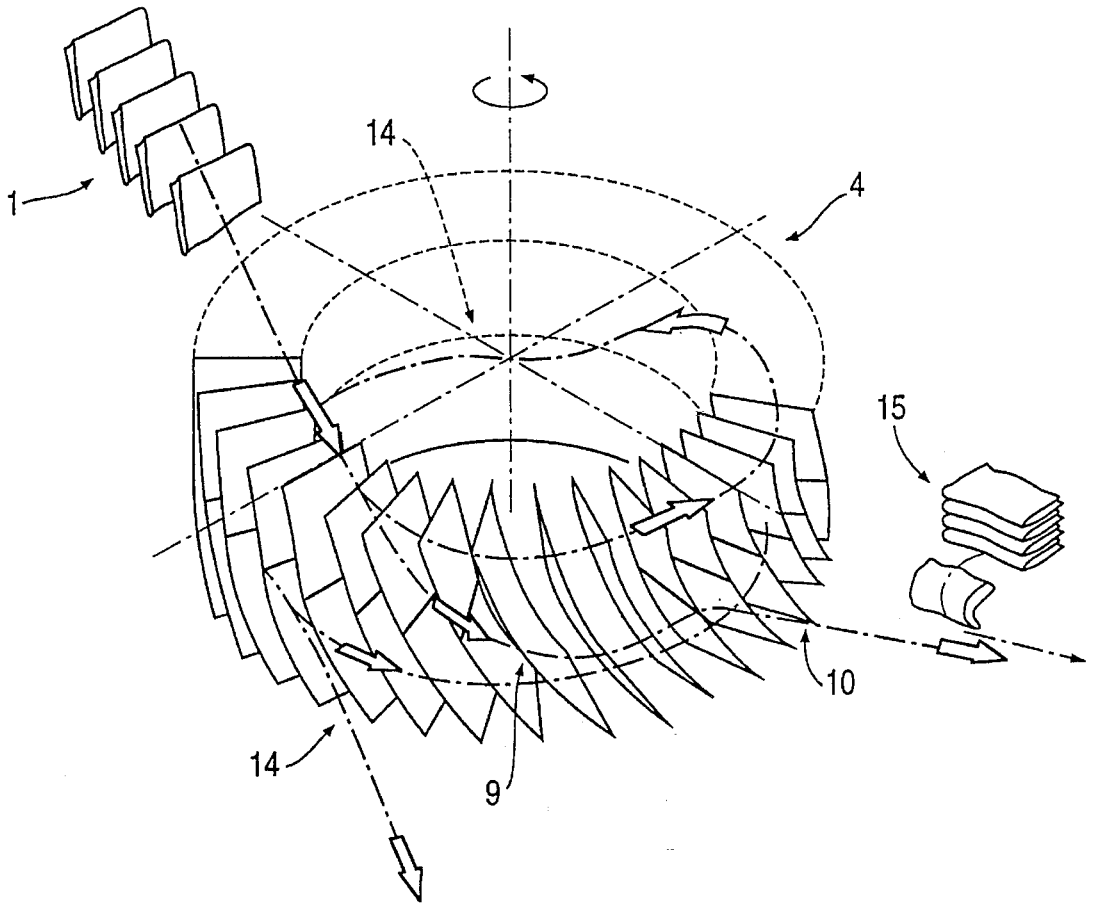
FIG. 3 is an illustration of the replacement process with an alternative helical circulation path.

FIG. 3 illustrates an alternative for the circulation track 4, also embodied with more than one helix, along which the following complete products 12 that replace the incomplete products drop from the upper pocket-like receiving devices 11 into the lower ones, which in the mean time have had products removed from them; the feed point 9 is formed in the region of the two helixes. In this embodiment, two removal points 14 are provided along the helix as opposed to one.

While there has been described what is presently believed to be the preferred embodiments of the invention, it will be apparent to one skilled in the art that numerous changes can be made in the structure set forth in the foregoing embodiment without departing from the invention as described herein and as defined in the appended claims.

What is claimed is:

1. A method of assembling printed products comprising the steps of:

selectively delivering the printed products to receiving devices situated in succession along a production line formed by a plurality of controlled sheet feeder stations;

selectively supplying printed products to a receiving device at a discharge end of the production line;

transferring at least indirectly the printed products selectively supplied to the receiving device at the discharge end of the production line to an upstream end of a helical circulation track which includes a plurality of further receiving devices driven in synchronism with the production line through a feed path disposed between the discharge end of the production line and the circulation track;

guiding the further receiving devices along a helical path defined by the circulation track between its upstream end and its downstream end;

removing any incomplete printed products from the printed products; and replacing the incomplete printed products with replacement complete printed products by delivering the replacement complete printed products to respective receiving devices of the circulation track corresponding to removed incomplete printed products at a feed point in the circulation track through the feed path, the feed path thereby being adapted to transfer both originally complete printed products and replacement complete printed products to the circulation track.

2. The method according to claim 1, further including the step of remanufacturing complete printed products during production on the production line whereby the replacement complete printed products are remanufactured complete printed products, the step of replacing thereby including the step of replacing the incomplete printed products with the remanufactured complete printed products.

3. The method according to claim 1, wherein the step of removing includes the step of removing the incomplete printed products from the printed products before the printed products reach the circulation track.

4. The method according to claim 1, further including the steps of discharging printed products from a discharge location of the circulation track, the step of removing including the step of removing the incomplete printed products from the printed products before the printed products reach the discharge location of the circulation track.

5. The method according to claim 1, wherein the step of replacing includes the step of feeding replacement complete printed products from a storage device for replacement complete printed products associated with the circulation track to the respective receiving devices of the circulation track corresponding to the removed incomplete printed products.

6. In an apparatus for producing printed products comprising:

a production line including receiving devices situated in succession therealong, the receiving devices being formed by a plurality of controlled sheet feeder stations; and a means for selectively delivering printed products to the receiving devices of the production line, the improvement comprising:

a feed path;

a helical circulation track located downstream of the production line, the feed path connecting the production line to the circulation track, the circulation track having an upstream end and a downstream end, the production line discharging at least indirectly into the upstream end of the circulation track, the circulation track further including:

a further plurality of receiving devices operatively coupled therein for receiving printed products from a discharge end of the production line;

a transfer point for receiving the printed products discharged from said production line through the feed path;

a feed point for receiving replacement complete printed products into receiving devices on the circulation track corresponding to incomplete printed products removed from the printed products, the feed point being located between the ends of the circulation track, the transfer point preceding the feed point relative to a direction of conveyance of the printed products on the circulation track; and a discharge location for discharging printed products from the circulation track, the discharge location being provided downstream of the feed point relative to a direction of conveyance of the printed products on the circulation track; and means operatively associated with at least one of the production line, the feed path and the circulation track for removing any incomplete printed products from the printed products, the feed path being adapted to transfer both originally complete printed products and replacement printed products to the circulation track.

7. The apparatus according to claim 6, further including a transfer means disposed between the discharge end of the production line and the transfer point of the circulation track for transferring printed products from the production line to the circulation track through the feed path.

8. The apparatus according to claim 6, wherein the means for removing includes a removal point disposed in the circulation track upstream of the feed point in the direction of conveyance of the printed products.

9. The apparatus according to claim 8, further including a storage device for replacement complete printed products associated with the circulation track and disposed downstream of the removal point.

10. The apparatus according to claim 6, wherein the circulation track is at least as long as the production line.

11. In an apparatus for producing printed products comprising:

a production line including receiving devices situated in succession therealong, the receiving devices being formed by a plurality of controlled sheet feeder stations and being configured to be supplied from above in pocket-like fashion, the receiving devices further including an openable bottom; and a means for selectively delivering printed products to the receiving devices of the production line, the improvement comprising:

a feed path;

a helical circulation track having a plurality of turns and being located downstream of the production line, the feed path connecting the production line to the circulation track, the circulation track including:

a further plurality of receiving devices operatively coupled therein for receiving printed products from a discharge end of the production line;

a transfer point for receiving the printed products discharged from said production line through the feed path;

a feed point for receiving replacement complete printed products into receiving devices on the circulation track corresponding to incomplete printed products removed from the printed products, the transfer point preceding the feed point relative to a direction of conveyance of the printed products on the circulation track; and a discharge location for discharging printed products from the circulation track, the discharge location being provided downstream of the feed point relative to a direction of conveyance of the printed products on the circulation track; and means operatively associated with at least one of the production line, the feed path and the circulation track for removing any incomplete printed products from the printed products, the feed path being adapted to transfer both originally complete printed products and replacement printed products to the circulation track.

12. The apparatus according to claim 11, wherein:

the means for removing removes the incomplete printed product from the receiving devices of the circulation track; and the circulation track includes upper and lower helical turns, the receiving devices of the circulation track being pocket-like, and the feed point being in a region of two superimposed pocket-like receiving devices disposed downstream of a location at which the incomplete printed products are removed by the removing means.

* * * * *